US011662094B2

(12) United States Patent
Broker

(10) Patent No.: US 11,662,094 B2
(45) Date of Patent: May 30, 2023

(54) SYSTEMS AND METHODS FOR FLAME MONITORING IN GAS POWERED APPLIANCES

(71) Applicant: Emerson Electric Co., St. Louis, MO (US)

(72) Inventor: John F. Broker, Warrenton, MO (US)

(73) Assignee: Emerson Electric Co., St. Louis, MO (US)

( * ) Notice: Subject to any disclaimer, the term of this patent is extended or adjusted under 35 U.S.C. 154(b) by 500 days.

(21) Appl. No.: 16/750,468

(22) Filed: Jan. 23, 2020

(65) Prior Publication Data

US 2021/0231304 A1 Jul. 29, 2021

(51) Int. Cl.

| | |
|---|---|
| ***F23N 5/02*** | (2006.01) |
| ***F24H 9/20*** | (2022.01) |
| *F24H 1/18* | (2022.01) |

(52) U.S. Cl.

CPC ..... *F23N 5/022* (2013.01); *F24H 9/2035* (2013.01); *F23N 2229/12* (2020.01); *F24H 1/186* (2013.01)

(58) Field of Classification Search

None

See application file for complete search history.

(56) References Cited

U.S. PATENT DOCUMENTS

| | | | | |
|---|---|---|---|---|
| 3,840,322 | A * | 10/1974 | Cade | F23N 5/203 431/46 |
| 2004/0174265 | A1* | 9/2004 | Kociecki | F23N 5/123 340/577 |
| 2007/0099136 | A1* | 5/2007 | Cook | F24H 9/2035 431/77 |
| 2010/0291494 | A1* | 11/2010 | Branecky | F23N 5/143 431/78 |
| 2012/0288806 | A1* | 11/2012 | Racaj | F23N 5/123 431/18 |

* cited by examiner

*Primary Examiner* — Steven B McAllister
*Assistant Examiner* — John E Bargero
(74) *Attorney, Agent, or Firm* — Armstrong Teasdale LLP

(57) ABSTRACT

A gas powered water heater includes a storage tank, a main burner, a flame sensor assembly, and a controller communicatively coupled to the flame sensor assembly. The flame sensor assembly includes a probe positioned proximate the main burner to couple an electric current to the main burner through a flame on the main burner and not to couple an electric current to the main burner when the flame is not present on the main burner, and a detector that provides signals representative of the electric current provided through the probe. The controller is programmed to determine a length of time taken for a transition between a signal representative of no electric current and a signal representative of a steady state electric current, and determine, based at least in part on the determined length of time, a strength of the flame on the main burner.

15 Claims, 6 Drawing Sheets

SYSTEMS AND METHODS FOR FLAME MONITORING IN GAS POWERED APPLIANCES

FIELD

The field of the disclosure relates generally to gas powered appliances, and more particularly, to systems and methods for flame monitoring in a gas powered water heater.

BACKGROUND

Gas powered appliances (such as a gas powered furnace, a gas powered oven, a gas powered water heater, and the like) include a burner at which gas is burned. Such appliances typically include a flame sensor to detect when a flame is present on the gas powered burner, so that gas is not emitted from the burner for extended periods of time when a flame is not present.

In at least some gas powered appliances, the flame sensor includes one or more electrodes positioned near the location of the expected flame from the gas powered burner. A voltage is applied to one of the electrodes. When no flame is present, there is no path for current from the electrode to which the voltage is applied, and no current flows from the electrode. When a flame is present on the burner, current will pass through the ionized gases of the flame from the electrode (e.g., to another electrode, to ground, to the burner, or the like). By monitoring for the presence or absence of this current (sometimes referred to as a flame current), the gas powered appliance can determine if a flame is present on the burner.

Moreover, the amount of current that will flow from the electrode varies somewhat depending on the strength of the flame. That is, a small or spluttering flame will allow less current to flow than a strong, normal flame. The flame current typically will have both a DC and an AC component. The DC portion of the current is typically used to indicate flame strength. Thus, at least some gas powered appliances attempt to monitor the value of the DC current to estimate the strength of the flame. Because the current flowing from the electrode and through the flame is very small (the DC portion is typically less than five microamps DC), such strength estimation is typically very coarse, providing only three levels: strong flame, weak flame, and no flame. Often the weak flame level is very close to the no flame level so not much warning time is available, once the weak flame level is reached, there is not much decrease in current until the flame will not be able to be detected and a no flame condition will exist and the appliance will not be able to provide function.

Because the flame sensor electrode is present in the combustion chamber near the flame of the gas powered appliance, the electrode typically becomes coated with deposits from the combustion. These deposits insulate the electrode, thereby reducing the current that can flow from the electrode. Thus, the amount of current flowing from the electrode may also be an indication of the condition of the electrode of the flame sensor. That is, a low current may indicate a weak flame, a dirty sensor electrode, or both.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the disclosure is a gas powered water heater. The gas powered water heater includes a storage tank for holding water, a main burner for burning gas to heat water in the storage tank, a flame sensor assembly, and a control system. The flame sensor assembly includes a probe positioned proximate the main burner to couple an electric current to the main burner through a flame on the main burner and not to couple an electric current to the main burner when the flame is not present on the main burner, and a detector that provides signals representative of the electric current provided through the probe. The control system is communicatively coupled to the flame sensor. The control system is programmed to control the main burner to selectively heat water in the storage tank, determine, based on the signals representative of the electric current, a length of time taken for a transition between a signal representative of no electric current and a signal representative of a steady state electric current, and determine, based at least in part on the determined length of time, a strength of the flame on the main burner.

In another aspect of the disclosure, a gas powered water heater includes a storage tank for holding water, a main burner for burning gas to heat water in the storage tank, a display, a flame sensor assembly, and a control system communicatively coupled to the flame sensor and the display. The flame sensor assembly includes a probe positioned proximate the main burner to couple an electric current through a flame on the main burner, and a detector that provides signals representative of the electric current provided through the probe. The control system is programmed to determine, based on the signals representative of the electric current, a length of time taken for a transition between a signal representative of no electric current and a signal representative of a steady state electric current, select, based at least in part on the determined length of time, a flame strength level from a plurality of more than three flame strength levels, and display, on the display, an indication of the selected flame strength level.

Another aspect of the disclosure is a gas powered appliance including a burner for burning gas, a display, a flame sensor assembly, and a control system communicatively coupled to the flame sensor and the display. The flame sensor assembly includes a probe positioned proximate the burner to couple an electric current to the burner through a flame on the burner and not to couple an electric current to the burner when the flame is not present on the burner, and a detector that provides signals representative of the electric current provided through the probe. The control system is programmed to determine, based on the signals representative of the electric current, a length of time taken for a transition between a signal representative of no electric current and a signal representative of a steady state electric current, determine, based at least in part on the determined length of time, a strength of the flame on the burner, and display, on the display, an indication of the determined strength of the flame, the indication selected by the control system from more than three possible strengths of the flame.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

For conciseness, examples will be described with respect to a gas powered water heater. However, the methods and systems described herein may be applied to any suitable gas powered appliance, including without limitation a gas powered dryer, a gas powered furnace, a gas powered oven.

Figure 1:
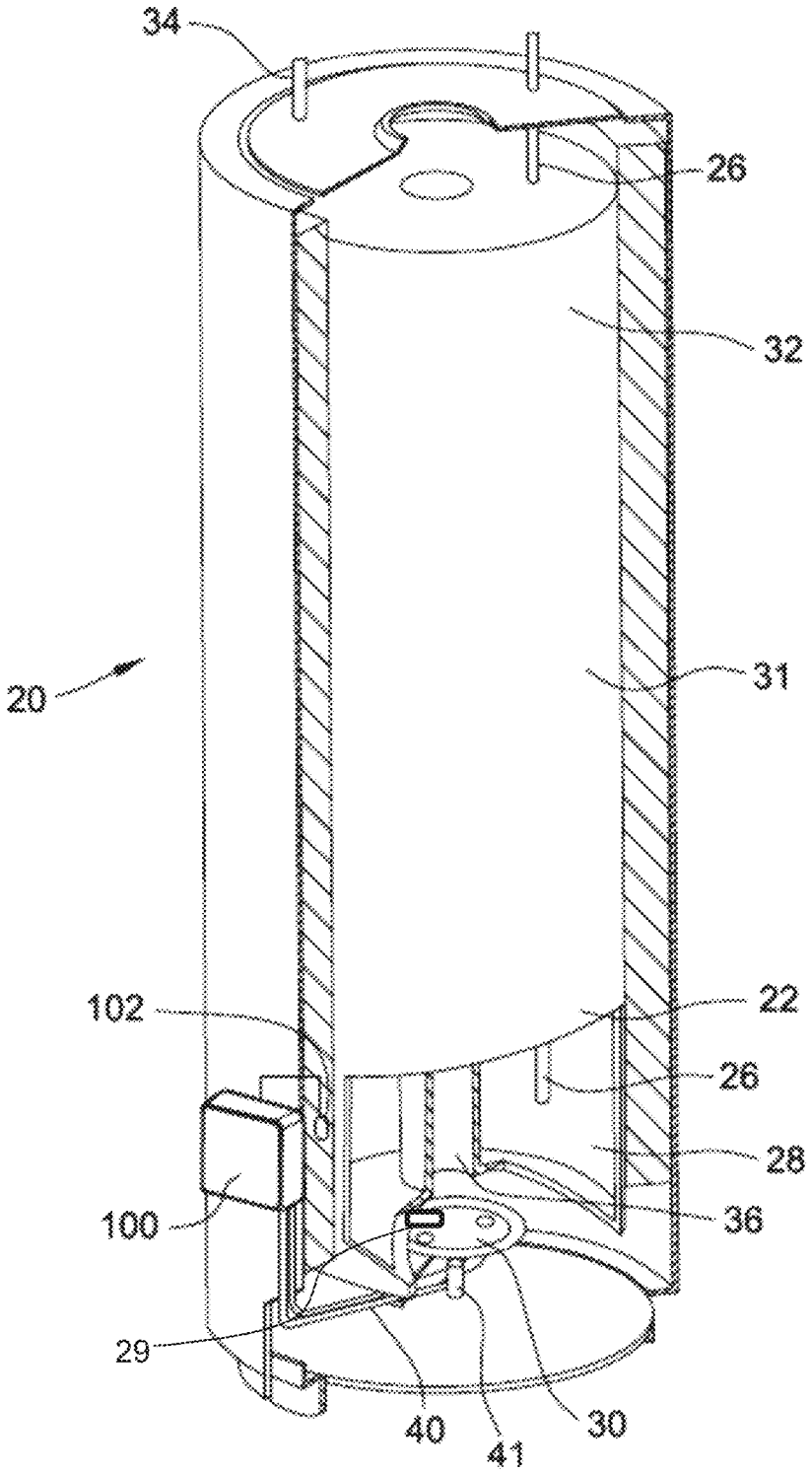
FIG. 1 is a cut-away view of a water heater including one embodiment of a control system for controlling operation of the water heater.

Referring initially to FIG. 1, a control system 100 is provided for controlling operation of a water heater 20 to maintain a setpoint temperature of water in the water heater 20. The water heater 20 has a storage tank 22 that stores heated water and receives cold water via a cold water inlet 26. Cold water entering a bottom portion 28 of the storage tank 22 is heated by a fuel-fired main burner 30 beneath the storage tank 22. Water leaves the storage tank 22 via a hot water outlet pipe 34. Combustion gases from the main burner 30 leave the water heater 20 via a flue 36. The control system 100 provides for control of gas flow via a gas supply line 40 and one or more valves (not shown) to the main burner 30, as described herein. The gas burned by the water heater 20 may be natural gas, liquid propane (LP) gas, or any other suitable gas for powering a water heater. A flame sensor 29 is communicatively coupled to the control system 100 and positioned near the main burner 30 to detect (for the control system 100) the presence or absence of a flame produced by the main burner 30. Moreover, the control system 100 controls a standing (i.e., continuously lit) pilot burner 41 that operates as an ignition source for the main burner 30. The control system 100 also controls gas flow via gas supply line 40 and one or more valves (not shown in FIG. 1) to the pilot burner 41. Alternatively, the ignition source may be a piezoelectric lighter or any other suitable ignition source. In some embodiments, a piezoelectric lighter is used to ignite the pilot burner 41.

The control system 100 includes a sensor 102 that provides an output or value that is indicative of a sensed temperature of the water inside of the storage tank 22. For example, the sensor 102 may be a tank surface-mounted temperature sensor, such as a thermistor. Alternatively, in other embodiments, the sensor 102 may be a temperature probe or any other sensor suitable for measuring the water temperature in storage tank 22. In the embodiment shown in FIG. 1, sensor 102 is positioned proximate bottom portion 28 of the storage tank 22. Alternatively, the sensor 102 may be positioned to detect the temperature of the water in the storage tank 22 at any other suitable portion or portions of the storage tank, such as a middle portion 31, an upper portion 32, or a combination of bottom, middle, and/or upper portions. Moreover, the control system 100 may include more than one sensor 102. For example, the control system 100 may include two or more temperature sensors 102 for detecting the water temperature at one or more locations in the storage tank 22. In one example, the control system 100 includes two sensors 102 that are thermistors mounted on a circuit board positioned within a watertight tube near the bottom of the storage tank 22. The two thermistors detect the temperature of the water near the bottom portion 28 of the storage tank 22.

The control system 100 is positioned, for example, adjacent the storage tank 22. Alternatively, the control system 100 is located underneath the storage tank 22, in a watertight compartment within the storage tank 22, or in any other suitable location. Sensor 102 is in communication with control system 100, and provides control system 100 an output or value indicative of the water temperature in storage tank 22. In some embodiments, a second sensor (not shown) may be disposed at an upper portion 32 of the water heater 20, to provide an output or value that is indicative of a sensed temperature of the water in upper portion 32 of storage tank 22. The flame sensor 29 is in communication with control system 100, and provides control system 100 an output or value indicative of the presence or absence of a flame on the main burner 30.

Various embodiments of the control system 100 may include and/or be embodied in a computing device. The computing device may include, a general purpose central processing unit (CPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer-readable medium including, without limitation, a storage device and/or a memory device. Such instructions, when executed by a processor, cause the processor to perform at least a portion of the methods described herein.

Figure 2:
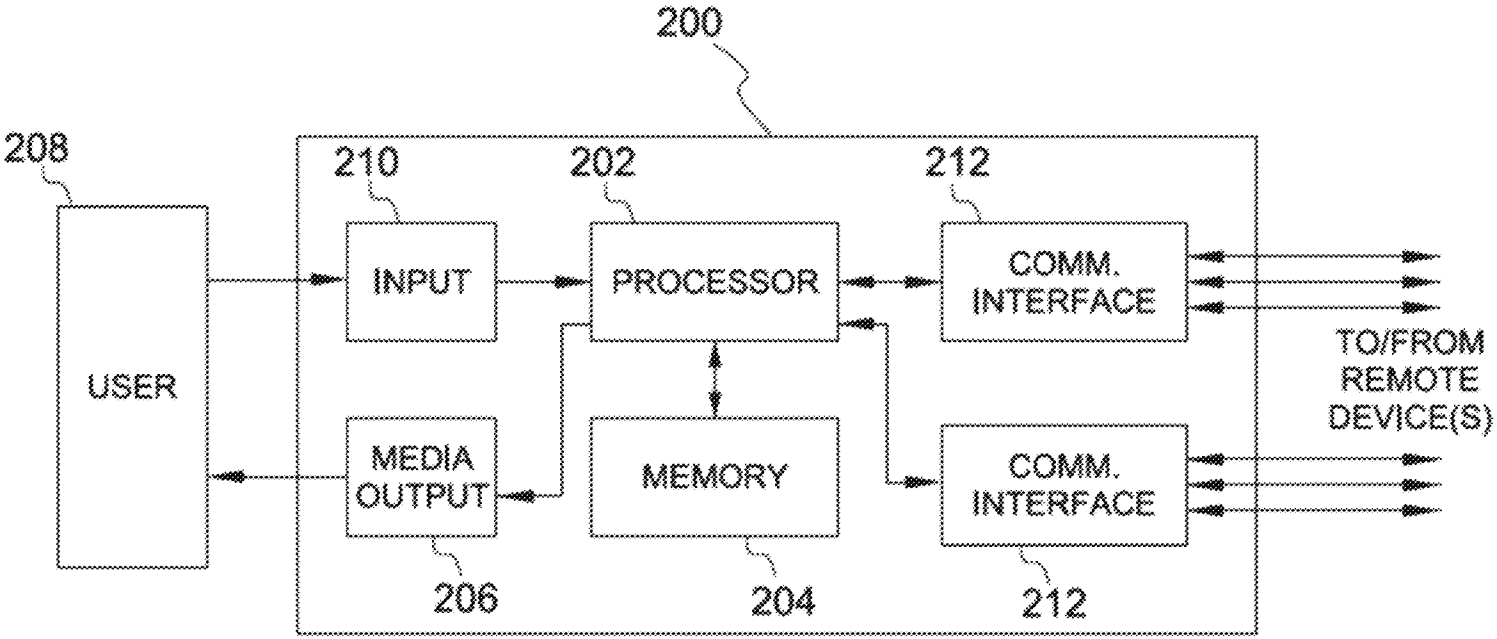
FIG. 2 is a block diagram of a computing device for use in the water heater shown in FIG. 1.

FIG. 2 is an example configuration of a computing device 200 for use as a controller in the control system 100. The computing device 200 includes a processor 202, a memory 204, a media output component 206, an input device 210, and communications interfaces 212. Other embodiments include different components, additional components, and/or do not include all components shown in FIG. 2.

The processor 202 is configured for executing instructions. In some embodiments, executable instructions are stored in the memory 204. The processor 202 may include one or more processing units (e.g., in a multi-core configuration). The memory 204 is any device allowing information such as executable instructions and/or other data to be stored and retrieved. The memory 204 may include one or more computer-readable media.

The media output component 206 is configured for presenting information to user 208. The media output component 206 is any component capable of conveying information to the user 208. In some embodiments, the media output component 206 includes an output adapter such as a video adapter and/or an audio adapter. The output adapter is operatively connected to the processor 202 and operatively connectable to an output device such as a display device (e.g., a liquid crystal display (LCD), organic light emitting diode (OLED) display, cathode ray tube (CRT), "electronic ink" display, one or more light emitting diodes (LEDs)) or an audio output device (e.g., a speaker or headphones).

In an example embodiment, the media output 206 is connected to a display device (shown in FIG. 3) on the water heater 20 that displays an indication of the strength of the flame produced by the main burner 30, as detected by the flame sensor 29. The indication of the strength of the flame may be represented on the display device by a displayed number (e.g., a percentage, a number within a predefined range of numbers, or the like), by the number of lighted LEDs in a group of LEDs, by the brightness of a light (e.g., brighter light for a stronger flame and weaker light for a weaker flame), by the color of a light, by a displayed text description of the strength of the flame (e.g., "strong flame"), or by any other suitable display of the absolute or relative strength of the flame detected by the flame sensor 29. Moreover, the flame sensor 29 operates through use of an electric current flowing through the flame produced by the main burner 30. In some embodiments, the controller 100 displays the value of the current flowing through the flame as the indication of the strength of the flame.

The computing device 200 includes, or is connected to, the input device 210 for receiving input from the user 208. The input device is any device that permits the computing device 200 to receive analog and/or digital commands, instructions, or other inputs from the user 208, including visual, audio, touch, button presses, stylus taps, etc. The input device 210 may include, for example, a variable resistor, an input dial, a keyboard/keypad, a pointing device, a mouse, a stylus, a touch sensitive panel (e.g., a touch pad or a touch screen), a gyroscope, an accelerometer, a position detector, or an audio input device. A single component such as a touch screen may function as both an output device of the media output component 206 and the input device 210.

The communication interfaces 212 enable the computing device 200 to communicate with remote devices and systems, such as sensors, valve control systems, safety systems, remote computing devices, and the like. The communication interfaces 212 may be wired or wireless communications interfaces that permit the computing device to communicate with the remote devices and systems directly or via a network. Wireless communication interfaces 212 may include a radio frequency (RF) transceiver, a Bluetooth® adapter, a Wi-Fi transceiver, a ZigBee® transceiver, a near field communication (NFC) transceiver, an infrared (IR) transceiver, and/or any other device and communication protocol for wireless communication. (Bluetooth is a registered trademark of Bluetooth Special Interest Group of Kirkland, Wash.; ZigBee is a registered trademark of the ZigBee Alliance of San Ramon, Calif.) Wired communication interfaces 212 may use any suitable wired communication protocol for direct communication including, without limitation, USB, RS232, I2C, SPI, analog, and proprietary I/O protocols. In some embodiments, the wired communication interfaces 212 include a wired network adapter allowing the computing device to be coupled to a network, such as the Internet, a local area network (LAN), a wide area network (WAN), a mesh network, and/or any other network to communicate with remote devices and systems via the network.

The memory 204 stores computer-readable instructions for control of the water heater 20 as described herein. In some embodiments, the memory area stores computer-readable instructions for providing a user interface to the user 208 via media output component 206 and, receiving and processing input from input device 210. The memory 204 includes, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are example only, and are thus not limiting as to the types of memory usable for storage of a computer program.

Figure 3:
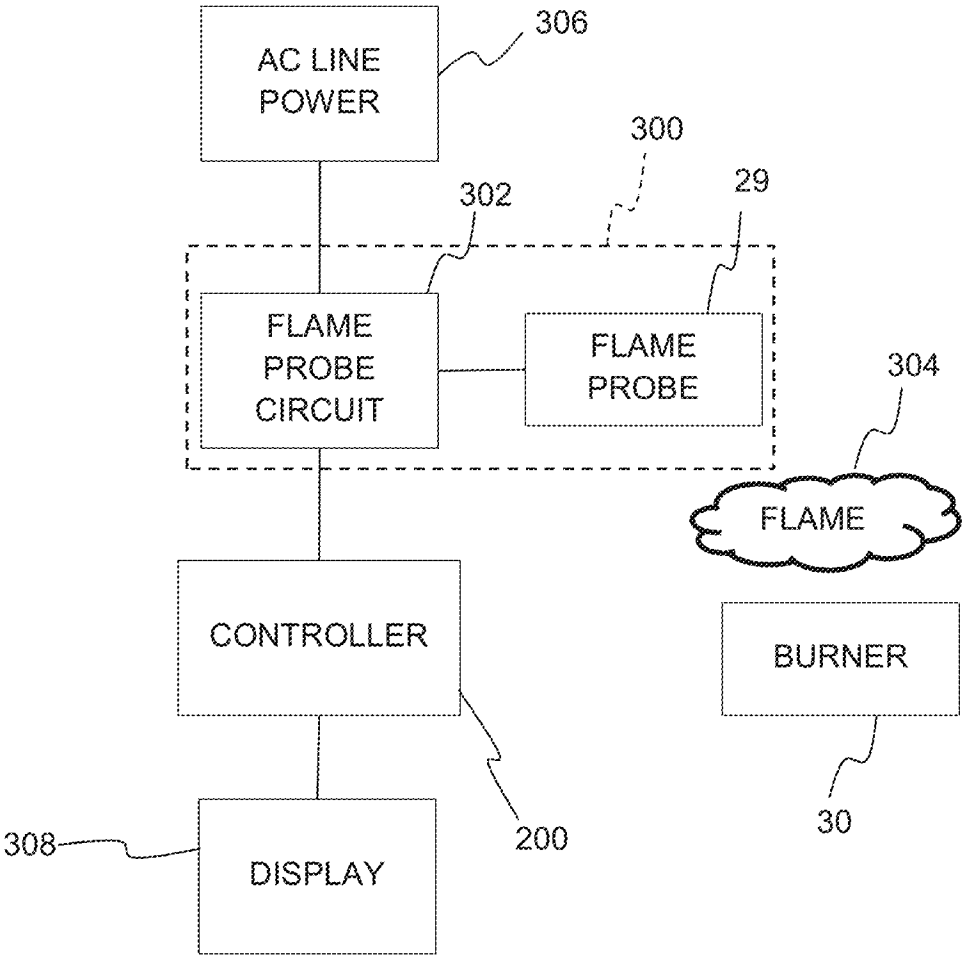
FIG. 3 is a block diagram of a portion of the water heater shown in FIG. 1 including a flame sensor assembly.

FIG. 3 is a block diagram of a portion of the water heater 20 including a flame sensor assembly 300. The flame sensor assembly 300 includes the flame probe 29 and a flame probe circuit 302 coupled to the flame probe 29. The flame probe circuit 302 and the controller 200 form at least part of the control system 100.

The flame probe 29 is positioned proximate the main burner 30 to couple an electric current to the main burner 30 through a flame 304 on the main burner 30 and not to couple an electric current to the main burner 30 when the flame is not present on the main burner 30. That is, when flame 304 is not present (e.g., because water is not being heated or because flame 304 has not been ignited on the main burner because of a failure), an open circuit exists between the flame probe 29 and the main burner 30. When the flame 304 exists, the flame (and the ionized gases around the flame) close the circuit between the main burner 30 and the flame probe 29, thereby allowing a small electrical current, consisting of an AC and a DC component, (influenced from AC power source 306) to flow from the flame probe 29 to the main burner 30.

The flame probe circuit 302 functions as a detector that detects when current is flowing from the flame probe to the burner and provides to the controller 200 signals representative of the electric current provided through the flame probe 29. The signals are digital signals that indicate either the flame 304 is present or the flame 304 is absent. The actual flame probe current is an AC current plus a DC current, the presence or absence of which is converted to the digital signal. When the flame 304 is present, current has been flowing from the flame probe to the burner, and the system is in a substantially steady state, the flame probe circuit 302 outputs a substantially constant logic high signal to the controller 200. When the flame 304 is not present, current has not been flowing from the flame probe to the burner, and the system is in a substantially steady state, the flame probe circuit 302 outputs a substantially constant logic low signal to the controller 200. Alternatively, a logic low signal may be used for the presence of the flame 304 and a logic high signal may be used for the absence of the flame 304. Because the flame current (i.e., the current from the flame probe 29 to the main burner 30) is an AC current plus a DC current and the flame acts like a diode for the AC flame current, when the main burner transitions between no flame and flame (in either direction), the signals output by the flame probe circuit 302 to the controller 200 will fluctuate between a logic high and a logic low output (at the same frequency as the AC power source 306) for a length of time before settling to a steady state (either logic high or logic low). The length of time during which the signal fluctuates is proportional to the amount of DC current flowing from the flame probe 29 to the main burner 30.

The control system 100 (and specifically the controller 200) is programmed to control the main burner 30 to selectively heat water in the storage tank 22. The control system 100 is also programmed to determine, based on the signals representative of the electric current, a length of time taken for a transition between a signal representative of no electric current and a signal representative of a steady state electric current (in either direction). Based at least in part on this determined length of time, the control system 100 determines a strength of the flame on the main burner 30.

The strength of the flame 304 may be determined as a flame current amount, a relative strength of flame (e.g., high, medium high, medium, medium low, low, no flame, and the like), a relative strength on a numerical scale (e.g., maximum flame=10, no flame=zero, and numbers between 0 and 10 indicate relative strengths between maximum flame and no flame), or as any other suitable representation of the strength of the flame 304. In the example embodiment, the control system 100 determines the strength of flame from more than three possible strengths of flame. That is, the control system 100 is programmed to determine an indication of the strength of the flame as an indication of one of a plurality of predetermined strengths, where the plurality of predetermined strengths is more than three strengths. Thus, the example system provides more granular information about the strength of flame than some known systems, which typically only determine the presence or absence of a flame, and possibly a low flame level between the two. In the example, each flame strength level represents a range of flame currents. Alternatively, each flame strength level may represent a specific flame current.

The control system 100 determines the strength of the flame 304 based on the length of time that the signal from the flame probe circuit fluctuates between logic high and logic low before settling to a steady state (whether logic high or logic low). In the example embodiment, the length of time is determined by monitoring an actual length of time taken from the first change in the logic state from the flame probe circuit 302 until the signal settles to either a logic high or logic low signal for a period of time (e.g., a predetermined number of cycles based on the frequency of the AC power source 306, a predetermined length of time, or the like). Alternatively, the determined length of time may be the number of fluctuations between the logic high and the logic low, rather than an actual time measurement.

The control system 100 compares the determined length of time to data stored in the memory 204 that indicates correspondences between lengths of time and the strength of the flame (or the value of the flame current as a representative of the strength of the flame). In some embodiments, the data is predetermined and has fixed correspondences. In other embodiments, the data is variable depending on the magnitude of the voltage output by the AC power source 306. This may be achieved by inclusion of multiple sets of correspondences, one for each of a plurality of different AC voltages, or by including one set of correspondences and scaling factors to adjust the one set of correspondences for different AC voltages. Embodiments that determine the strength of flame based in part on the voltage of the AC power source 306 may also include a voltage sensor (not shown) to detect the voltage input by from the AC power source 306. Alternatively, a user may input the voltage of the AC power source 306 to the control system 100, such as via input 210.

In other embodiments, the control system 100 may calculate the strength of the flame (or the value of the flame current as a representative of the strength of the flame) based on the determined length of time. For example, the control system 100 may multiply the determined length of time by a current magnitude per unit time (or number of fluctuation cycles) to arrive at the flame current, which may be used as a representative of the strength of the flame. For the flame off to on time, the shorter the time the more the current, so it is inversely related, not proportional, but for the flame on to off time, the shorter is weaker and longer is stronger (more current).

In some embodiments, the control system 100 is programmed to set initial values for the flame current in response to a received user input (such as via input 210) and determine future strengths of flame relative to those initial values. For example, this setting may be performed when the water heater 20 is first assembled and/or any time the flame probe 29 is replaced or cleaned. Thus, the control system 100 may learn the maximum flame strength when the flame probe is new (or newly replaced) and determine subsequent flame strengths relative to the maximum flame strength detection of the particular flame probe 29 when new. For example, the control system 100 may store, in the memory 204, an initial length of time taken for a transition between a signal representative of no electric current and a signal representative of the steady state electric current as a maximum flame strength in response to a received input from a user. The control system 100 then determines a plurality of lengths of time longer than the initial length of time corresponding to a plurality of flame strength levels less than the maximum flame strength. Subsequently, when the controller 200 receives signals from the flame probe circuit 302, the control system 100 determines the strength of the flame on the main burner 30 by comparison of the determined length of time to the correspondences stored in the memory. In other embodiments, the control system 100 may store, in the memory 204, an initial length of time taken for a transition between a signal representative of no electric current and a signal representative of the steady state electric current as a maximum flame strength in response to a received input from a user, without calculating the plurality of lengths of time longer than the initial length of time. Rather, in such embodiments, when the controller receives subsequent signals from the flame probe circuit 302, the controller determines the strength of the flame on the main burner 30 by comparison of the determined length of time to the initial length of time.

In the example embodiment, the control system 100 displays on a display 308, an indication of the strength of the flame determined by the control system 100. The display may be displayed as a number or a word on the display 308, when the display 308 is capable of displaying numbers and/or text. For example, the display may be of a number on an arbitrary scale (e.g., a number between 1 and 10, with 10 being maximum flame), a percentage of the maximum flame, a word description of the flame strength (e.g., "maximum flame," "medium flame," and the like), the magnitude of the flame current determined by the control system 100, or any other suitable text or numerical display. Alternatively, the display may be a symbolic display, such as lighting a particular number of lights (e.g., LEDs) on the display 308, lighting a particular light that indicates a particular flame strength (e.g., a light next to a printed label that reads "maximum flame"), lighting different colored lights (or changing the color or a single light) to indicate the strength of flame (e.g., green for maximum flame strength, red for no flame, and various other colors for flame strengths between maximum flame and no flame), or any other suitable symbolic display of the flame strength level.

The control system 100 is programmed in some embodiments to output an alert when the determined strength of the flame on the main burner 30 is less than a threshold value indicating a strong flame and greater than a threshold value indicating no flame is present. That is, an alert threshold value between no flame and maximum flame is stored in the memory 204. When the control system 100 determines a flame strength that is less than the alert threshold value, the control system 100 outputs an alert to indicate that a low flame is present and/or the flame probe 29 is dirty or faulty. The alert may be a human cognizable alert, such as a visible alert (e.g., lighting an alert light, flashing on or more lights, displaying "alert" on the display 308, or the like), or an audible alert (e.g., ringing a bell, sounding a siren, playing a melody through a speaker, or the like). Additionally, or alternatively, the alert may be an electronic alert, such as a signal output from the communication interface 212 to a remote computing device. The remote computing device may be a monitoring computer, the user's computer, the user's mobile communication device (e.g., a cell phone, tablet, or the like), a smart home hub, or any other suitable remote computing device. In some embodiments, the control system 100 stores, in the memory 204, an indication that the alert was sent and data about the alert (e.g., determined length of time, determined flame strength, date of occurrence, time of day, input voltage, and/or other suitable data). This data may then be accessed by the user or a repair person either through the user interface or remotely.

In some embodiments, the control system 100 makes at least some determinations by comparison of historical data about the flame current. In such embodiments, the control system 100 stores the determined flame currents in the memory 204 during operation. In some embodiments, the control system 100 analyzes that stored data to estimate when the flame probe 29 will need to be repaired, cleaned, or replaced. As explained above, over time the flame probe 29 will accumulate an insulating coating that will gradually decrease the current that flows through the flame probe 29 (even under otherwise same conditions). By comparing previous measurements, a rate of decline in the measured flame current can be determined, and the time when the measured flame current will be too low can be estimated. This time may be stored in the memory 204 for retrieval by a user or repair person, or may be transmitted to a remote computing device (similar to the alerts discussed above). Similarly, by storing the previous flame current determinations, the control system 100 may compare the present flame current determination to the previous determinations to identify anomalous determinations. For example, over a long period of time, the determined flame current will gradually (and relatively smoothly) decrease at a determinable rate. If a present time determination varies significantly (i.e., much more than the determined rate of decrease), the controller may determine that there may be a problem with the water heater 20, such as a catastrophic failure of the flame probe 29, damage/contamination of the main burner 30 resulting in a significantly lower flame, or the like. In such circumstances, the control system 100 may output an alert similar to the alerts discussed above so that the water heater 20 may be inspected, cleaned, and repaired as needed.

Figure 4:
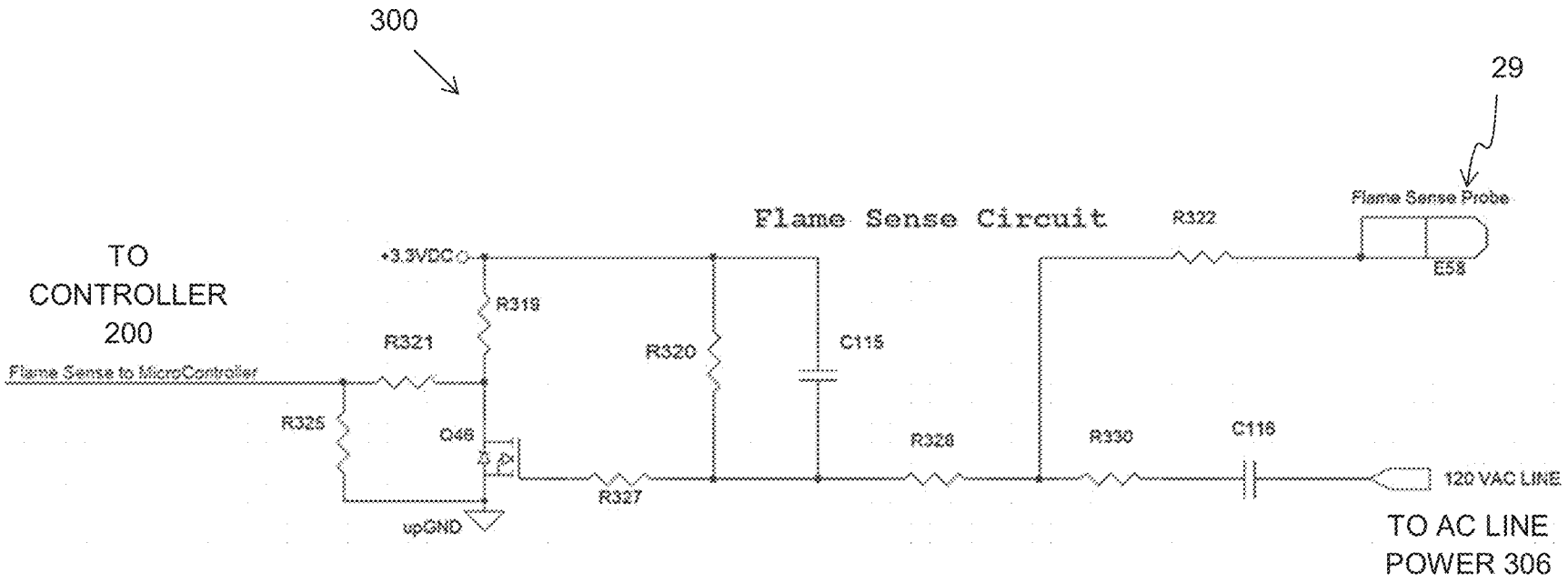
FIG. 4 is a circuit diagram of an embodiment of the flame sensor assembly shown in FIG. 3.

FIG. 4 is a circuit diagram of an example flame probe circuit 302 for use in the flame probe assembly 300. When no current is flowing from the flame probe 29 to the main burner 30, the gate of the MOSFET Q45 is sufficiently high voltage to turn on (i.e., make conducting) the MOSFET Q45, thus making the voltage on R321 low with respect to 3.3 VDC and thus a low DC voltage or no voltage (e.g., 0V) is output to controller 200 as a logical low signal indicating that no flame is detected. When current begins to flow from flame probe 29 to the main burner 30 because a flame has been ignited, the voltage on the gate of the MOSFET Q45 will have a DC and AC component and will move lower with time. As this voltage crosses the turn on voltage of the gate of FET Q45, because of the AC component, Q45 will be alternately be turned ON and OFF. This will cause the voltage on R321 to alternately be Low and High respectively. In this state, the signal sent to controller 200 will be alternating low and high. If the flame current is high enough to pull the voltage of the gate of FET Q45 to where even with the AC component the voltage is always below the FET Q45 turn on voltage, then the FET will remain OFF and the voltage on R321 will be High and the signal sent to controller 200 will be high, or close to 3.3 VDC, indicating that a flame is present. Thus, during this length of time, the control system 100 receives a pulsating signal that fluctuates between indicating that a flame is present and no flame is present. As the flame increases and the system reaches a steady state, the voltage on the gate of the MOSFET Q45 will reach a steady state at a low voltage keeping the MOSFET Q45 off, and providing a substantially constant logic high signal to the controller 200, thereby indicating that the flame is detected. Here, the time to go from all low flame signal to all high flame signal is inversely proportional to the steady state flame current, i.e., stronger flame takes a shorter time to transition from all low to all high and a weaker flame takes a longer time to transition from all low to all high. A similar process happens, when the flame on the main burner 30 is extinguished. That is, the previously constant logic high signal begins to pulse between high and low until a steady state is reached, the MOSFET Q45 remains on, and a substantially constant low signal is output to the controller 200. Here, the time to go from all high flame signal to all low no flame signal is proportional to the steady state flame current, i.e., stronger flame takes a longer time to transition from all high to all low and a weaker flame takes a shorter time to transition from all High to all low.

Figure 5:
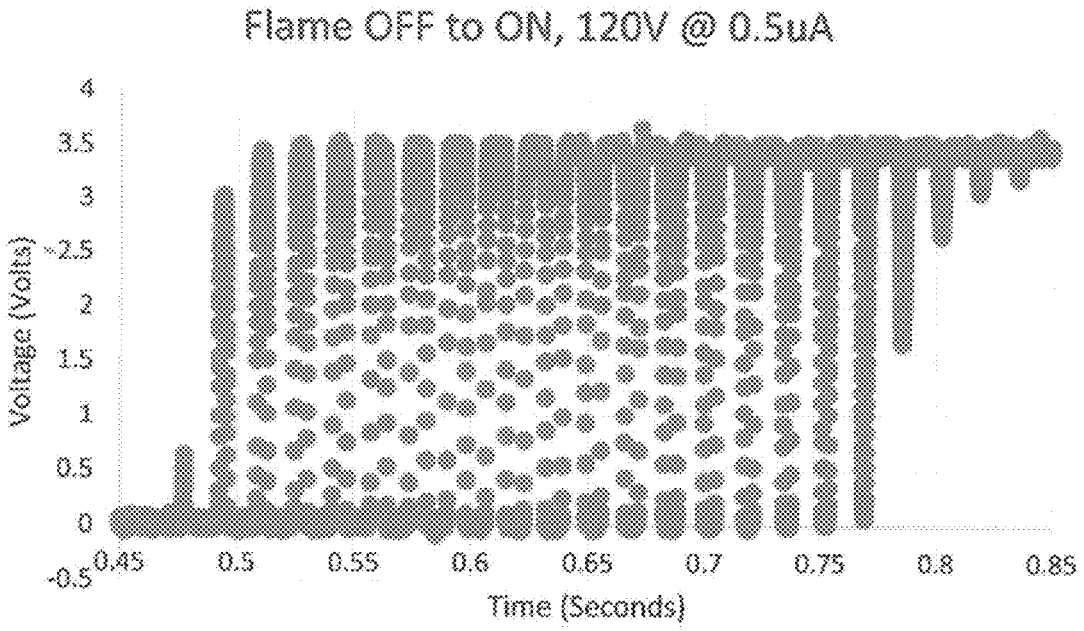
FIGS. 5 and 6 are graphs of simulated outputs of the flame probe circuit.
Figure 6:
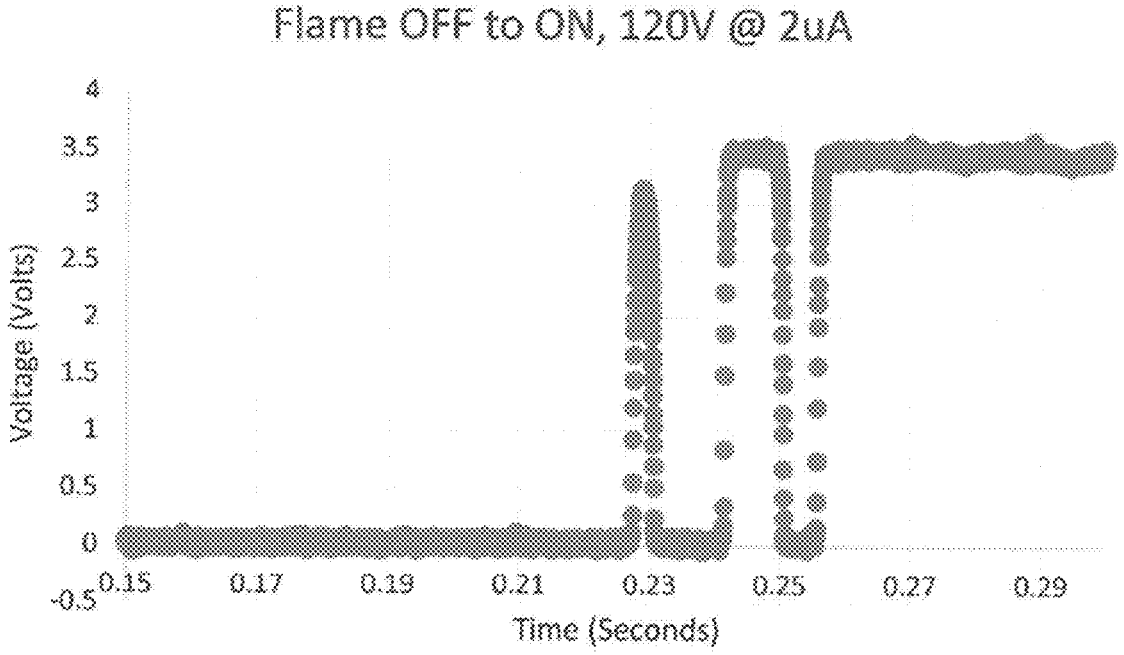

FIGS. 5 and 6 are graphs of simulated outputs of the flame probe circuit 302 in FIG. 4 for a 0.5 microamp (μA) flame current and a 2.0 μA flame current respectively. As can be seen, for the 0.5 μA flame current in FIG. 5, the output pulses between 3.5 volts and 0 volts for approximately 0.35 seconds. In contrast, for a 2 μA flame current, the pulses last less than 0.04 seconds. It should also be noted that the number of pulses of the output (which occur approximately at the same frequency of the AC power source 306) increase as the flame current decreases. Thus, based on either the length of time that the pulses last or the number of pulses that occur before a steady state is reached, the control system 100 can determine the flame current that is flowing. It should also be noted that the relationship between current and length of time (and number of pulses) inverts during turn off of the flame. That is, when turning off the flame, the length of time that the signal pulses is longer for a larger flame current and there are more pulses for the larger flame current.

Figure 7:
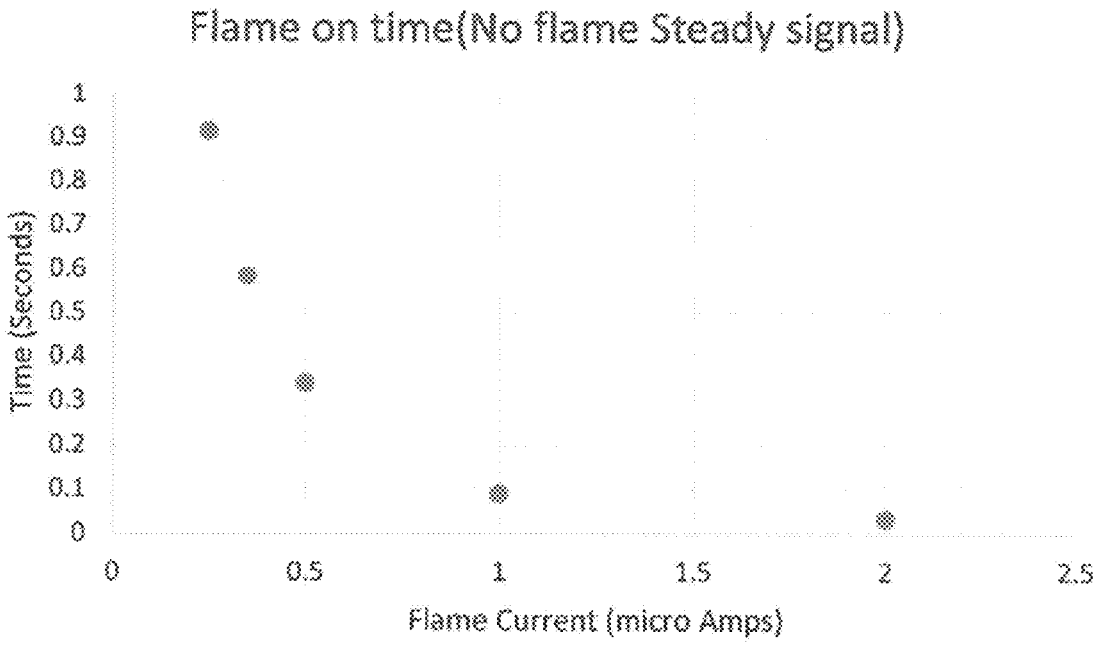
FIGS. 7 and 8 are graphs of the approximate length of time for the transition between a no flame present output and a flame present output for the flame probe circuit.
Figure 8:
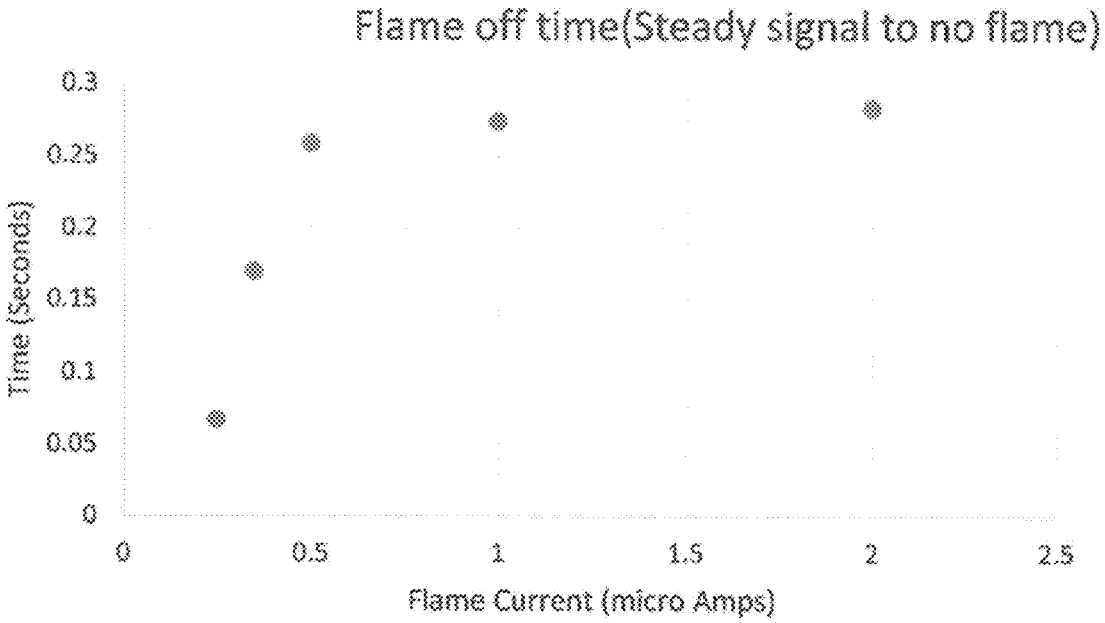

FIGS. 7 and 8 are graphs of the approximate length of time for the transition between a no flame present output and a flame present output for the flame probe circuit 302 in FIG. 4 for various flame currents. FIG. 7 graphs the times for a transition from no flame present to flame present (i.e., when the flame is first ignited on the main burner 30), while FIG. 8 graphs the times for a transition from a signal representative of flame present to a signal representative of no flame present (i.e., when the flame on the main burner 30 is extinguished). It can be seen that the length of time that the output signal fluctuates appears to vary more when transitioning from no flame present to flame present (FIG. 7) than the transition when the flame is extinguished (FIG. 8). For example, during turn on (FIG. 7), the time difference between a 0.5 μA flame current and a 2 μA flame current is about 0.3 seconds, while during turn off (FIG. 8), the time difference for the same flame currents is less than 0.05 seconds. Thus, the use of the length of time that the output signal of the flame probe circuit 302 pulses during the transition from no flame present to flame present may be preferred in some embodiments to allow more granularity, the use of lower sampling rates, and the like.

Embodiments of the methods and systems described herein achieve superior results compared to prior methods and systems. The systems are operable to detect multiple flame current levels to provide a more detailed view of the operation of the gas powered appliance. Moreover, the example systems and methods do so without the need for a sensitive current sensor capable of detecting differences of a few microamps of current. Further the example methods and systems may provide early warning of the need for appliance maintenance, and/or flame probe replacement or repair. On installations where the flame probe is not located correctly to give a good flame signal, the methods and systems of this disclosure allow the poor location to be detected early during installation and corrected. For appliances, such as gas furnaces, that may be inspected infrequently (e.g., once per year), the example systems and methods allows for more accurate estimation of whether or not the appliance will last until the next inspection without needing service on the flame probe by providing better/earlier warning of a failing/dirty probe.

Example embodiments of systems and methods for controlling a water heater are described above in detail. The system is not limited to the specific embodiments described herein, but rather, components of the system may be used independently and separately from other components described herein. For example, the controller and processor described herein may also be used in combination with other systems and methods, and are not limited to practice with only the system as described herein.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A gas powered water heater comprising:

a storage tank for holding water;

a main burner for burning gas to heat water in the storage tank;

a flame sensor assembly including:

a probe positioned proximate the main burner to couple an electric current including an alternating current (AC) component and a direct current (DC) component to the main burner through a flame on the main burner and not to couple an electric current to the main burner when the flame is not present on the main burner, and a detector that provides signals representative of the electric current provided through the probe; and a controller connected to the flame sensor assembly, the controller programmed to:

control the main burner to selectively heat water in the storage tank, determine a length of time that the signals representative of the electric current alternate between a signal representative of no electric current and a signal representative of a steady state electric current before settling to the signal representative of no electric current or the signal representative of the steady state electric current, and determine, based at least in part on the determined length of time, a strength of the flame on the main burner, wherein the controller comprises a memory storing correspondences between different flame strengths and different lengths of time that the signals representative of the electric current alternate between the signal representative of no electric current and the signal representative of the steady state electric current before settling to the signal representative of no electric current or the signal representative of a steady state electric current, and wherein the controller is programmed to determine the strength of the flame on the main burner by comparison of the determined length of time to the correspondences stored in the memory.

2. The gas powered water heater of claim 1, further comprising a display, wherein the controller is further programmed to display, on the display, an indication of the strength of the flame determined by the controller.

3. The gas powered water heater of claim 2, wherein the indication of the strength of the flame comprises an indication of one of a plurality of predetermined strengths, and the plurality of predetermined strengths comprises more than three strengths.

4. The gas powered water heater of claim 3, wherein the display comprises a plurality of light emitting diodes (LEDs), and the controller is programmed to light a different number of LEDs for each different predetermined strength.

5. The gas powered water heater of claim 1, wherein the controller comprises a memory, and the controller is programmed to:

store, in the memory, an initial length of time that the signals representative of the electric current alternate between the signal representative of no electric current and the signal representative of the steady state electric current before settling to the signal representative of no electric current or the signal representative of a steady state electric current as a maximum flame strength in response to a received input from a user;

determine a plurality of lengths of time longer than the initial length of time corresponding to a plurality of flame strength levels less than the maximum flame strength;

storing the plurality of lengths of time longer than the initial length of time corresponding to the plurality of flame strength levels less than the maximum flame strength as the correspondences between different flame strengths and different lengths of time that the signals representative of the electric current alternate between the signal representative of no electric current and the signal representative of the steady state electric current before settling to the signal representative of no electric current or the signal representative of a steady state electric current; and determine the strength of the flame on the main burner by comparison of the determined length of time to the correspondences stored in the memory.

6. The gas powered water heater of claim 1, wherein the controller is programmed to output an alert when the determined strength of the flame on the main burner is less than a threshold value indicating a strong flame and greater than a threshold value indicating no flame is present.

7. A gas powered water heater comprising:

a storage tank for holding water;

a main burner for burning gas to heat water in the storage tank;

a display;

a flame sensor assembly including:

a probe positioned proximate the main burner to couple an electric current including an alternating current (AC) component and a direct current (DC) component through a flame on the main burner, and a detector that provides signals representative of the electric current provided through the probe; and a controller communicatively coupled to the flame sensor assembly and the display, the controller programmed to:

determine a length of time that the signals representative of the electric current alternate between a signal representative of no electric current and a signal representative of a steady state electric current before settling to the signal representative of no electric current or the signal representative of the steady state electric current, select, based at least in part on the determined length of time, a flame strength level from a plurality of more than three flame strength levels, and display, on the display, an indication of the selected flame strength level, wherein the controller comprises a memory storing correspondences between different flame strength levels and different lengths of time that the signals representative of the electric current alternate between the signal representative of no electric current and the signal representative of the steady state electric current before settling to the signal representative of no electric current or the signal representative of a steady state electric current, and wherein the controller is programmed to select the flame strength level by comparison of the determined length of time to the correspondences stored in the memory.

8. The gas powered water heater of claim 7, wherein the display comprises a plurality of light emitting diodes (LEDs), and the controller is programmed to light a different number of LEDs for each different flame strength level.

9. The gas powered water heater of claim 7, wherein the controller comprises a memory, and the controller is programmed to:

store, in the memory, an initial length of time that the signals representative of the electric current alternate between the signal representative of no electric current and the signal representative of the steady state electric current before settling to the signal representative of no electric current or the signal representative of a steady state electric current as a maximum flame strength in response to a received input from a user;

determine a plurality of lengths of time longer than the initial length of time corresponding to a plurality of flame strength levels less than the maximum flame strength level;

store, in the memory, the plurality of lengths of time longer than the initial length of time corresponding to a plurality of flame strength levels less than the maximum flame strength level as the correspondences between different flame strength levels and different lengths of time that the signals representative of the electric current alternate between the signal representative of no electric current and the signal representative of the steady state electric current before settling to the signal representative of no electric current or the signal representative of a steady state electric current; and determine the flame strength level by comparison of the determined length of time to the correspondences stored in the memory.

10. The gas powered water heater of claim 7, wherein the controller is programmed to output an alert when the determined flame strength level is less than a flame strength level indicating a strong flame and greater than a flame strength level indicating no flame is present.

11. A gas powered appliance comprising:

a burner for burning gas;

a display;

a flame sensor assembly including:

a probe positioned proximate the burner to couple an electric current to the burner through a flame on the burner and not to couple an electric current to the burner when the flame is not present on the burner, and a detector that provides signals representative of the electric current including an alternating current (AC) component and a direct current (DC) component provided through the probe; and a controller communicatively coupled to the flame sensor assembly and the display, the controller programmed to:

determine a length of time that the signals representative of the electric current alternate between a signal representative of no electric current and a signal representative of a steady state electric current before settling to the signal representative of no electric current or the signal representative of the steady state electric current, determine, based at least in part on the determined length of time, a strength of the flame on the burner, and display, on the display, an indication of the determined strength of the flame, the indication selected by the controller from more than three possible strengths of the flame, wherein the controller comprises a memory storing correspondences between different flame strengths and different lengths of time that the signals representative of the electric current alternate between the signal representative of no electric current and the signal representative of the steady state electric current before settling to the signal representative of no electric current or the signal representative of a steady state electric current, and wherein the controller is programmed to determine the strength of the flame by comparison of the determined length of time to the correspondences stored in the memory.

12. The gas powered appliance of claim 11, wherein the display comprises a plurality of light emitting diodes (LEDs), and the controller is programmed to light a different number of LEDs to indicate each of the more than three possible strengths of the flame.

13. The gas powered appliance of claim 11, wherein the controller comprises a memory, and the controller is programmed to:

store, in the memory, an initial length of time that the signals representative of the electric current alternate between the signal representative of no electric current and the signal representative of the steady state electric current before settling to the signal representative of no electric current or the signal representative of a steady state electric current as a maximum flame strength in response to a received input from a user;

determine a plurality of lengths of time longer than the initial length of time corresponding to a plurality of flame strength levels less than the maximum flame strength;

store, in the memory, the plurality of lengths of time longer than the initial length of time corresponding to a plurality of flame strength levels less than the maximum flame strength as the correspondences between different flame strengths and different lengths of time that the signals representative of the electric current alternate between the signal representative of no electric current and the signal representative of the steady state electric current before settling to the signal representative of no electric current or the signal representative of a steady state electric current; and determine the strength of the flame on the main burner by comparison of the determined length of time to the correspondences stored in the memory.

14. A gas powered appliance comprising:

a burner for burning gas;

a display;

a flame sensor assembly including:

a probe positioned proximate the burner to couple an electric current to the burner through a flame on the burner and not to couple an electric current to the burner when the flame is not present on the burner, and a detector that provides signals representative of the electric current including an alternating current (AC) component and a direct current (DC) component provided through the probe; and a controller communicatively coupled to the flame sensor assembly and the display, the controller programmed to:

determine a length of time that the signals representative of the electric current alternate between a signal representative of no electric current and a signal representative of a steady state electric current before settling to the signal representative of no electric current or the signal representative of the steady state electric current, determine, based at least in part on the determined length of time, a strength of the flame on the burner, and display, on the display, an indication of the determined strength of the flame, the indication selected by the controller from more than three possible strengths of the flame, wherein the controller comprises a memory, and the controller is programmed to:

store, in the memory, an initial length of time that the signals representative of the electric current alternate between the signal representative of no electric current and the signal representative of the steady state electric current before settling to the signal representative of no electric current or the signal representative of a steady state electric current_as a maximum flame strength in response to a received input from a user; and determine the strength of the flame by comparison of the determined length of time to the initial length of time.

15. The gas powered appliance of claim 11, wherein the controller is programmed to output an alert when the determined strength of the flame on the burner is less than a threshold value indicating a strong flame and greater than a threshold value indicating no flame is present.

* * * * *